US011685873B2

(12) United States Patent
Allan et al.

(10) Patent No.: US 11,685,873 B2
(45) **Date of Patent: *Jun. 27, 2023**

(54) METHODS AND USES FOR CONTROLLING DEPOSITS ON VALVES IN DIRECT-INJECTION SPARK-IGNITION ENGINES

(71) Applicant: BP OIL INTERNATIONAL LIMITED, Middlesex (GB)

(72) Inventors: Robert Edward Allan, Berkshire (GB); Ross Alexander Dewhurst, Berkshire (GB); Michael John Grundy, Berkshire (GB); David Michael Williamson, Berkshire (GB)

(73) Assignee: BP OIL INTERNATIONAL LIMITED, Middlesex (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/905,093

(22) PCT Filed: Aug. 21, 2014

(86) PCT No.: PCT/EP2014/067868

§ 371 (c)(1),
(2) Date: Jan. 14, 2016

(87) PCT Pub. No.: WO2015/028391

PCT Pub. Date: Mar. 5, 2015

(65) Prior Publication Data

US 2016/0160143 A1 Jun. 9, 2016

(30) Foreign Application Priority Data

Aug. 27, 2013 (EP) ..... 13181875

(51) Int. Cl.

| | |
|---|---|
| ***C10L 10/06*** | (2006.01) |
| ***C10L 1/22*** | (2006.01) |
| ***C10L 10/18*** | (2006.01) |
| ***C10L 1/14*** | (2006.01) |
| ***C10L 1/238*** | (2006.01) |
| ***C10L 1/2383*** | (2006.01) |
| ***C10L 1/198*** | (2006.01) |
| ***C10L 1/2387*** | (2006.01) |
| ***C10L 1/222*** | (2006.01) |
| ***C10L 1/236*** | (2006.01) |

(52) U.S. Cl.

CPC ..... *C10L 10/06* (2013.01); *C10L 1/143* (2013.01); *C10L 1/198* (2013.01); *C10L 1/22* (2013.01); *C10L 1/238* (2013.01); *C10L 1/2383* (2013.01); *C10L 1/2387* (2013.01); *C10L 10/18* (2013.01); *C10L 1/221* (2013.01); *C10L 1/2222* (2013.01); *C10L 1/2225* (2013.01); *C10L 1/236* (2013.01); *C10L 2200/0259* (2013.01); *C10L 2200/0423* (2013.01); *C10L 2270/023* (2013.01); *C10L 2300/20* (2013.01)

(58) Field of Classification Search

CPC ..... C10L 1/2383; C10L 1/198; C10L 1/238; C10L 1/2387; C10L 1/143; C10L 1/22; C10L 1/221; C10L 1/2222; C10L 1/2225; C10L 1/236; C10L 2300/20; C10L 2200/0259; C10L 2200/0423; C10L 2270/023; C10L 10/06; C10L 10/18

USPC ..... 44/424

See application file for complete search history.

(56) References Cited

U.S. PATENT DOCUMENTS

| | | | | |
|---|---|---|---|---|
| 248,664 | A | 10/1881 | Norton | |
| 2,425,755 | A | 8/1947 | Roberts et al. | |
| 2,425,845 | A | 8/1947 | Toussaint et al. | |
| 2,457,139 | A | 12/1948 | Fife et al. | |
| 4,152,499 | A | 5/1979 | Boerzel et al. | |
| 4,166,726 | A | 9/1979 | Harle | |
| 4,832,702 | A | 5/1989 | Kummer et al. | |
| 5,634,951 | A | 6/1997 | Colucci et al. | |
| 5,697,988 | A | 12/1997 | Malfer et al. | |
| 5,720,253 | A * | 2/1998 | Matoba | F02B 23/104 123/298 |
| 6,048,373 | A | 4/2000 | Malfer et al. | |
| 6,140,541 | A | 10/2000 | Melder et al. | |
| 6,800,103 | B2 | 10/2004 | Malfer et al. | |
| 6,909,018 | B1 | 6/2005 | Melder et al. | |
| 7,597,726 | B2 | 10/2009 | Hou et al. | |
| 7,753,970 | B2 | 7/2010 | Bergemann et al. | |
| 2003/0029077 | A1* | 2/2003 | Jackson | C10L 1/146 44/425 |
| 2005/0172546 | A1* | 8/2005 | Spivey | C10L 1/224 44/412 |
| 2005/0215441 | A1 | 9/2005 | Mackney et al. | |

(Continued)

FOREIGN PATENT DOCUMENTS

| | | | |
|---|---|---|---|
| DE | 2904314 | A1 | 8/1980 |
| EP | 1081209 | A1 | 3/2001 |

(Continued)

OTHER PUBLICATIONS

International Search Report (ISR) with Written Opinion of PCT/EP2014/067868 dated Dec. 5, 2014, pp. 1-13.

*Primary Examiner* — Latosha Hines

(74) *Attorney, Agent, or Firm* — McDonnell, Boehnen, Hulbert & Berghoff LLP

(57) ABSTRACT

The use as a valve deposit controlling additive in a fuel composition for a direct injection spark-ignition internal combustion engine of a combination of: a) at least one hydrocarbyl-substituted aromatic compound; and b) at least one polyalkylene amine.

4 Claims, No Drawings

(56) References Cited

U.S. PATENT DOCUMENTS

| | | | | |
|---|---|---|---|---|
| 2006/0010767 | A1* | 1/2006 | Arters | C10L 1/143 44/412 |
| 2006/0277820 | A1* | 12/2006 | Puri | C10L 1/143 44/415 |
| 2008/0086936 | A1 | 4/2008 | Cunningham et al. | |
| 2008/0202561 | A1* | 8/2008 | DuMont | C10L 10/18 510/185 |
| 2008/0289249 | A1* | 11/2008 | Hou | C10L 10/18 44/347 |
| 2009/0071065 | A1 | 3/2009 | Malfer et al. | |
| 2010/0107484 | A1* | 5/2010 | Vilardo | C10L 10/06 44/410 |

FOREIGN PATENT DOCUMENTS

| | | | |
|---|---|---|---|
| EP | 1293553 | A2 | 3/2003 |
| EP | 1506992 | A1 | 2/2005 |
| WO | 2003/014267 | A2 | 2/2003 |
| WO | 2003/078553 | A2 | 9/2003 |
| WO | 2011/151207 | A1 | 12/2011 |
| WO | 2013/075978 | A1 | 5/2013 |

* cited by examiner

METHODS AND USES FOR CONTROLLING DEPOSITS ON VALVES IN DIRECT-INJECTION SPARK-IGNITION ENGINES

CROSS-REFERENCE TO RELATED APPLICATIONS

This application claims priority to International Patent Application No. PCT/EP2014/067868, filed Aug. 21, 2014, which claims priority to EP 13181875.9, filed Aug. 27, 2013, all of which are hereby incorporated herein by reference in their entireties.

FIELD

This invention relates to methods and uses and in particular aspects to a method of controlling deposit formation on valves in a direct injection, spark-ignition internal combustion engine and in other aspects to the use of a combination of additives as a valve deposit controlling additive in a fuel composition for a direct injection spark-ignition internal combustion engine.

BACKGROUND

In general, there are two types of spark-ignition internal combustion engine which are classified according to the type of system for delivering fuel to the engine combustion chambers:

- Port Fuel Injection (PFI) engines—engines in which a mixture of fuel and air is injected into intake ports and then passes into combustion chambers of the engine through one or more intake valves (sometimes also called inlet valves or inlet port valves); and
- Direct Injection (DI) engines—engines in which fuel is injected directly into combustion chambers of the engine through injectors (sometimes also called direct injectors or direct injector nozzles) and air is introduced into the combustion chambers through one or more air intake valves (sometimes also called air inlet valves or air inlet port valves).

In some direct injection engines in certain operating conditions, fuel is passed through the air intake valves from time to time.

Deposits on the air intake valves of a direct injection spark-ignition internal combustion engine may adversely affect the performance of the engine, for example in respect of driveability including for example power output and acceleration.

Deposits may also build up on other valves in the engine, such as exhaust valves and exhaust gas recirculation valves.

According to its abstract, U.S. Pat. No. 4,166,726 relates to a fuel additive comprising a mixture of a polyalkylene amine and the reaction product of an alkylphenol, an aldehyde and an amine, which is said to provide stability in preventing thermal degradation of fuels, particularly fuels for compression ignition engines.

According to its abstract, US2005/0215441 relates to a method of operating an internal combustion engine in which a nitrogen-containing detergent composition is introduced into a combustion chamber of the engine wherein the detergent composition contains (A) a reaction product of a hydrocarbyl-substituted acylating agent and an amine, (B) a hydrocarbyl-substituted amine, (C) a Mannich reaction product, (D) a high molecular weight polyetheramine, or (E) a mixture thereof.

In paragraph [0077] to [paragraph [0081] of US2005/0215441 experiments are described using Ford pre-production 3-cylinder direct injection spark ignited 1.125 L engines equipped with EGR. The additised fuel contained a Mannich reaction product. The effect of addition to the fuel of dispersant/detergent on the distance accumulated prior to TBN:TAN cross-over of the lubricant was reported.

According to its paragraph [0030], US 2008/0086936 relates to a method of reducing deposits formed in an internal combustion engine combusting an ethanol-gasoline blend, said method comprising combining the blend with at least one additive selected from the group consisting of 2,6-di t-butyl phenol antioxidant, methylcyclopentadienyl manganese tricarbonyl combustion improver and octane enhancer, oleic acid plus N,N' dimethylcyclohexylarnine, dodecenyl succinic acid, polyisobutylene amine dispersant, 1,2 propane diamine salicylaldehyde metal deactivator, cresol Mannich Base dispersant, diethanol amide of isostearic acid friction modifier, and 2-ethyl hexyl nitrate combustion improver, whereby the deposits formed in said engine are less than the deposits formed in the engine when combusting the blend without the at least one additive.

According to its abstract, US2003/0029077 relates to a fuel composition comprising a hydrocarbon fuel, a combination of nitrogen-containing detergents that includes a hydrocarbyl-substituted polyamine and a Mannich reaction product, and optionally a fluidizer. Methods of operating and of controlling deposits in an internal combustion engine involve fuelling the engine with the fuel composition which is said to result in control of deposits in the fuel induction system.

According to its paragraph [0002], US2006/0277820 relates to a deposit control additive composition comprising polyisobutylene amine (PIBA) having an average molecular weight of about 700 to about 1000 and a Mannich Base as synergistic components of the deposit control additive formulation.

Paragraph [0015] of US 2006/0277820 states:

> "Mannich Bases have been used in isolation or in combination with diamine to reduce deposits on carburettor surfaces. As disclosed in the present application surprising result has been achieved by using a Mannich Base and Polyisobutylene amine as synergistic components of a deposit control additive formulation to drastically reduce deposits on carbutet[t] or and keep port fuel injectors and fuel valves clean in gasoline fuel[l]ed spark ignition internal combustion engines."

Paragraph [0069] of US2006/0277820 relates to an Inlet Valve Deposit Test using Mercedes Benz M111 Engine as per CEC F-20-A-98 and paragraph [0070] relates to Port Fuel Injector Fouling Bench Test.

In direct injection spark-ignition internal combustion engines, intake valve deposits (IVD) may accumulate on the intake valves used to control intake of air into the combustion chambers. Although in some direct injection engines, in certain operating conditions, fuel may be passed over the air intake valves from time to time, in general, these inlet or intake valves of direct injection engines are not usually subject to (and hence cannot benefit from) a flow of fuel through the intake valves. Instead, the fuel is injected into the combustion chambers separately from the air, through direct injectors (sometimes also called direct injector nozzles).

Deposits may also accumulate on other valves over or through which the fuel generally does not flow. Exhaust valves and exhaust gas recirculation valves are examples.

Therefore, there remains a need for methods and uses aspects of which reduce or at least mitigate problems, for example as identified above.

BRIEF SUMMARY

Thus, according to a first aspect of the present invention, there is provided a method of controlling deposit formation on valves in a direct injection spark-ignition internal combustion engine which method comprises supplying to the engine, a fuel composition which comprises a combination of:

a. at least one hydrocarbyl-substituted aromatic compound; and b. at least one polyalkylene amine.

In a preferred embodiment, there is provided a method of controlling deposit formation on air intake valves in a direct injection spark-ignition internal combustion engine which method comprises supplying to the engine, a fuel composition which comprises a combination of:

a. at least one Mannich Base detergent; and b. at least one polyisobutylene amine.

According to a further aspect of the present invention, there is provided the use as a valve deposit controlling additive in a fuel composition for a direct injection spark-ignition internal combustion engine of a combination of:

a. at least one hydrocarbyl-substituted aromatic compound; and b. at least one polyalkylene amine.

In a preferred embodiment, there is provided the use as an air intake valve deposit controlling additive in a fuel composition for a direct injection spark-ignition internal combustion engine of a combination of:

a. at least one Mannich Base detergent; and b. at least one polyisobutylene amine.

According to another aspect of the present invention, there is provided a method of reducing the valve deposit forming tendency of a fuel composition for use in a direct injection spark-ignition internal combustion engine which method comprises incorporating into the fuel composition in one or more steps:

a. at least one hydrocarbyl-substituted aromatic compound; and b. at least one polyalkylene amine to produce a fuel composition which comprises said additives in combination and which on combustion in a direct injection spark-ignition engine controls the formation of valve deposits.

In a preferred embodiment, there is provided a method of reducing the direct injection air intake valve deposit forming tendency of a fuel composition for use in a direct injection spark-ignition internal combustion engine which method comprises incorporating into the fuel composition in one or more steps:

a. at least one Mannich Base detergent; and b. at least one polyisobutylene amine to produce a fuel composition which comprises said additives in combination and which on combustion in a direct injection spark-ignition engine produces less air intake valve deposits than the air intake valve deposits formed when combusting in said engine the fuel composition without said combination of additives.

According to another aspect of the present invention, there is provided a method of operating a direct injection spark-ignition internal combustion engine which method comprises supplying to the engine, a fuel composition which comprises a combination of:

a. at least one hydrocarbyl-substituted aromatic compound; and b. at least one polyalkylene amine.

In a preferred embodiment, there is provided a method of operating a direct injection spark-ignition internal combustion engine which method comprises supplying to the engine, a fuel composition which comprises a combination of:

a. at least one Mannich Base detergent; and b. at least one polyisobutylene amine.

According to a further aspect of the present invention, there is provided the use of a combination of:

a. at least one hydrocarbyl-substituted aromatic compound; and b. at least one polyalkylene amine for improving the valve deposit formation control performance of a fuel composition in a direct injection spark-ignition internal combustion engine.

In a preferred embodiment, there is provided the use of a combination of:

a. at least one Mannich Base detergent; and b. at least one polyisobutylene amine for improving the air intake valve deposit formation control performance of a fuel composition in a direct injection spark-ignition internal combustion engine.

DETAILED DESCRIPTION

Aspects of the present invention address the technical problems identified and others, by the use in combination of at least one hydrocarbyl-substituted aromatic compound, such as a Mannich Base detergent, and at least one polyalkylene amine, such as a polyisobutylene amine.

In particular, it has been found that a fuel composition comprising a combination of at least one hydrocarbyl-substituted aromatic compound, such as a Mannich Base detergent, and at least one polyalkylene amine, such as a polyisobutylene amine, when used in a direct injection, spark-ignition internal combustion engine, exhibits beneficial valve deposit control, for example in "keep clean" deposit control.

Polyalkylene Amine

The polyalkylene amine may be a poly $C_{1-10}$-alkylene amine. For instance, the polyalkylene amine may be polyethylene amine, a polypropylene amine, a polybutylene amine, a polypentylene amine or a polyhexylene amine. In examples, the polyalkylene amine is a polybutylene amine, in particular a polyisobutylene amine.

Accordingly, in embodiments, at least one polyisobutylene amine may be used in the fuel composition.

Polyisobutylene amines are also sometimes called polyisobutylamine or PIBA. Examples of suitable polyisobutylene amines include mono-amines, di-amines and polyamines of polyisobutylene including for example, polyisobutylene that is a homopolymer of isobutylene and polyisobutylene that is a polymer of isobutylene with minor amounts (for example up to 20% by weight), of one or more other monomers including for example n-butene, propene and mixtures thereof.

Examples of suitable polyisobutylene amines include polyisobutylene amines disclosed in, and/or obtained or obtainable by methods described in, U.S. Pat. Nos. 4,832,702, 6,140,541, 6,909,018 and/or 7,753,970.

Examples of suitable polyisobutylene amines include polyisobutylene amines disclosed in, and/or obtained or obtainable by methods described in, U.S. Pat. No. 4,832, 702. Thus, suitable polyisobutylene amines include compounds represented by the structural formula I:

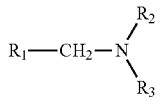

(I)

in which $R_1$ is a polybutyl- or polyisobutyl group derivable or derived from isobutene and up to 20% by weight of n-butene and $R_2$ and $R_3$ are identical or different and are each independently:

hydrogen;

an aliphatic or aromatic hydrocarbyl group;

a primary or secondary, aromatic or aliphatic aminoalkylene group or polyaminoalkylene group;

a polyoxyalkylene group;

a heteroaryl or heterocyclyl group; or together with the nitrogen atom to which they are bonded form a ring in which further hetero atoms may be present.

In at least some examples $R_2$ and $R_3$ are identical or different and are each independently:

hydrogen;

alkyl;

aryl;

hydroxyalkyl; or an aminoalkylene group represented by the general formula (II):

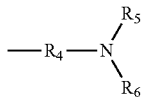

(II)

wherein $R_4$ is alkylene and $R_5$ and $R_6$ are identical or different and are each independently: hydrogen; alkyl; aryl; hydroxyalkyl; polybutyl; or polyisobutyl; or a polyaminoalkylene group represented by the general formula (III):

$$[—R_4—NR_5]_mR_6 \quad (III)$$

wherein the $R_4$ groups are the same or different and the $R_5$ groups are the same or different and $R_4$, $R_5$ and $R_6$ have the above meaning and m is an integer from 2 to 8; or a polyoxyalkylene group represented by the general formula (IV):

$$[—R_4—O—]_nX \quad (IV)$$

wherein the $R_4$ groups are the same or different and have the above meaning, X is alkyl or H and n is an integer from 1 to 30.

In at least some examples $R_2$ and $R_3$ together with the nitrogen atom to which they are bonded form a morpholinyl, pyridyl, piperidyl, pyrrolyl, pyrimidinyl, pyrolinyl, pyrrolidinyl, pyrazinyl or pyridazinyl group.

In at least some examples $R_1$ is a polybutyl or polyisobutyl group containing 20 to 400 carbon atoms which is derived or derivable from isobutene and up to 20% by weight n-butene.

In at least some examples $R_1$ is a polybutyl or polyisobutyl group containing 32 to 200 carbon atoms which is derived or derivable from isobutene and up to 20% by weight n-butene and $R_2$ and $R_3$ identical or different and are each independently: hydrogen, methyl, ethyl, n-propyl, isopropyl, n-butyl, sec-butyl, isobutyl, tert-butyl, pentyl, hexyl, phenyl, $—CH_2—CH_2—NH_2$, $—CH_2—CH_2—CH_2—N(CH_3)_2$, or $—[—CH_2—CH_2—NH]_p—CH_2—CH_2—NH_2$ where p is an integer from 1 to 7, for example 1 to 3, $—CH_2—CH_2—OH$, $—[—CH_2—CH_2—O]_q—CH_2—OH$ where q is an integer from 1 to 30, or together with the nitrogen atom to which they are bonded, form a morpholinyl group.

Examples of suitable polyisobutylene amines additives also include polyisobutylene amines disclosed in, and/or obtained or obtainable by methods described in, described in U.S. Pat. Nos. 6,140,541 and 6,909,018. Thus, examples of suitable polyisobutylene amines include compounds represented by the formula (V):

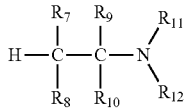

(V)

wherein $R_7$, $R_8$, $R_9$ and $R_{10}$ independently of one another, are each hydrogen or an unsubstituted or substituted, saturated or mono- or polyunsaturated aliphatic group exhibiting a number average molecular weight of up to 40000, at least one of the groups $R_7$ to $R_{10}$ exhibiting a number average molecular weight of from 150 to 40000, and $R_{11}$ and $R_{12}$ independently of each other are each H; an alkyl group, for example a $C_1$ to $C_{18}$ alkyl group; a cycloalkyl group; a hydroxyalkyl group; an aminoalkyl group; an alkenyl group; an alkynyl group, an aryl group; an arylalkyl group; an alkylaryl group; a hetaryl group; an alkylene-imine group represented by the formula (VI):

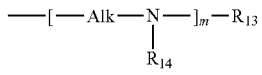

(VI)

wherein:

Alk is a straight-chain or branched alkylene m is an integer from 0 to 10; and $R_{13}$ and $R_{14}$, independently of one another, are each H; an alkyl group, for example a $C_1$ to $C_{18}$ alkyl group; a cycloalkyl group; a hydroxyalkyl group; an aminoalkyl group; an alkenyl group; an alkynyl group, an aryl group; an arylalkyl group; an alkylaryl group; a hetaryl group or, together with the nitrogen atom to which they are bonded, form a heterocyclic structure, or $R_{11}$ and $R_{12}$, together with the nitrogen atom to which they are bonded, form a heterocyclic structure.

In at least some examples each of $R_{11}$, $R_{12}$, $R_{13}$ and $R_{14}$ are independently substituted by further alkyl groups carrying hydroxy or amino groups.

Examples of suitable polyisobutylene amines additives also include polyisobutylene amines disclosed in, and/or obtained or obtainable by methods described in, U.S. Pat. No. 7,753,970. Thus, examples of suitable polyisobutylene amines include polyisobutylene amines that are derived or derivable from polyisobutenes derived or derivable from isobutene or an isobutenic monomer mixture, for example a mixture of isobutene and up to 20% by weight of n-butene. Suitable polyisobutylene amines include polyisobutene amines derived or derivable from polyisobutylene that is derived or derivable by the polymerisation of identical or different straight-chain or branched $C_4$ olefin monomers, which in at least some examples, are suitably randomised in the polymerisation product. Suitable polyisobutylene amines include polyisobutylene amines that are derived or derivable from highly reactive polyisobutenes. Highly reactive polyisobutenes contain a high content of terminal double bonds (also sometimes referred to alpha-olefinic double bonds and/or vinylidene double bonds), for example at least 20%, or at least 50%, or at least 70% of the total olefinic double bonds in the polyisobutene. These are sometimes represented by the general structure:

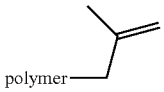

Highly reactive polyisobutenes may be made by methods described for example in U.S. Pat. No. 4,152,499.

In at least some examples the polyisobutylene amine contains a polyisobutenic group that exhibits a number average molecular weight of from 200 to 10000, for example from 500 to 5000 or from 700 to 1500 or from 800 to 1200 or from 850 to 1100, for example about 1000.

In at least some examples the polyisobutylene amine is derived from or derivable from a polyisobutene that exhibits at least one of the following properties:

(i) being derivable or derived from isobutene and up to 20% by weight of n-butene;
(ii) being derivable or derived from isobutenic mixture containing at least 70 mol. % vinylidene double bonds based on the total olefinic bonds in the polyisobutene;
(iii) containing at least 85% by weight isobutylene units;
(iv) a polydispersity in the range of from 1.05 to 7

Methods of making suitable polyisobutylene amines are described for example in U.S. Pat. Nos. 4,832,702, 6,140,541, 6,909,018 and/or 7,753,970.

In at least some examples the polyalkylene amine, such as the polyisobutylene amine, is present/used in the fuel composition at a concentration of actives of at least 50 ppm, for example at a concentration of actives of at least 100 ppm. In at least some examples the polyisobutylene amine is present/used in the fuel composition at a concentration as actives of up to 500 ppm, for example at a concentration of up to 300 ppm. In at least some examples the polyalkylene amine, such as the polyisobutylene amine, is present/used in the fuel composition at a concentration of actives in the range of from 50 ppm to 500 ppm, for example at a concentration of actives in the range of from 50 ppm to 300 ppm, such as from 100 ppm to 300 ppm. Concentration of actives means the concentration of the active polyalkylene amine disregarding for example, any solvent or the like. As will be clear to the skilled person, the concentration of actives expressed herein in terms of ppm is ppm by weight.

Typically, the at least one polyalkylene amine, such as the at least one polyisobutylene amine, will be present/used in the fuel composition at a concentration of actives of from 50 ppm to 160 ppm. In some examples, however, higher treat rates may be used. In such instances, the at least one polyalkylene amine may be present/used in the fuel composition at a concentration of from 160 ppm to 500 ppm.

Hydrocarbyl-Substituted Aromatic Compound.

The at least one hydrocarbyl-substituted aromatic compound may be a hydrocarbyl-substituted hydroxyaromatic compound, such as a hydrocarbyl-substituted phenol compound. The hydrocarbyl substituent may attach at the ortho-, meta- or para-position of the phenol ring.

The hydrocarbyl substituent of the hydrocarbyl-substituted aromatic compound may exhibit a number average molecular weight of from 700 to 1500, such as from 900 to 1300.

In embodiments, at least one Mannich Base detergent may be used in the fuel composition.

Examples of Mannich Base detergents include those obtained or obtainable by the reaction of at least one hydrocarbyl-substituted hydroxyaromatic compound, at least one amine and at least one aldehyde under Mannich condensation reaction conditions. Suitable reaction conditions include at least one (for example, all) of the following conditions:

at a temperature in the range of from 40° C. to 200° C.;
in the absence or presence of solvent;
for a reaction time in the range of from 2 to 4 hours; and
with azeotropic distillative removal of water by-product.

Examples of aldehydes suitable for the preparation of Mannich Base detergents include:

aliphatic aldehydes, including for example, formaldehyde, acetaldehyde, propionaldehyde, butyraldehyde, valeraldehyde, caprioaldehyde, heptaldehyde and stearaldehyde;
aromatic aldehydes including for example, benzaldehyde and salicylaldehyde; and heterocyclic aldehydes including for example, furfural aldehyde and thiophene aldehyde.

Also useful in at least some examples are formaldehyde precursors including for example paraformaldehyde and aqueous formaldehyde solutions including for example formalin.

Examples of representative hydrocarbyl substituents of the hydrocarbyl-substituted hydroxyaromatic compound include for example, polyolefin polymers for example polypropylene, polybutenes, polyisobutylene, ethylene alpha-olefin copolymers and the like. Other examples include copolymers of butylene and/or isobutylene and/or propylene and one or more mono-olefinic comonomers copolymerisable therewith (for example ethylene, 1-pentene, 1-hexene, 1-octene, 1-decene and the like) where the comonomer molecule contains at least 50% by weight of butylene and/or isobutylene and/or propylene units. In some examples the copolymers are aliphatic and in some examples contain non-aliphatic groups (for example styrene, o-methylstyrene, p-methylstyrene, divinyl benzene and the like), in any case the resulting polymers are substantially aliphatic hydrocarbon polymers.

Examples of suitable Mannich Base detergents include Mannich Base detergents in which the hydrocarbyl substituent of the aromatic group is or comprises polyisobutylene. Such compounds are sometimes called PIB-Mannich Base detergents.

In at least some examples hydrocarbyl substituents of the hydrocarbyl-substituted hydroxyaromatic compound include polymers obtained or obtainable from pure or substantially pure 1-butene; polymers obtained or obtainable from pure or substantially pure isobutene; and polymers obtained or obtainable from mixtures of 1-butene, 2-butene and isobutene. In at least some examples the hydrocarbyl-substituted hydroxyaromatic reactant is obtained or obtainable from high reactive polyisobutene. High reactive polyisobutenes contain a high content of terminal double bonds (also sometimes referred to alpha-olefinic double bonds and/or vinylidene double bonds), for example at least 20%, or at least 50%, or at least 70% of the total olefinic double bonds in the polyisobutene. Examples of high reactivity polybutylenes containing relatively high proportions of polymer molecules comprising a terminal vinylidene group include those that are obtained or obtainable by methods described in U.S. Pat. No. 4,152,499 and DE2904314.

In at least some examples the hydrocarbyl substituents contain some residual unsaturation but in general they are substantially saturated.

In at least some examples the hydrocarbyl substituent is a polymer exhibiting a polydispersity of from 1 to 4, for example from 1 to 2, for example as determined by gel permeation chromatography (sometimes also referred to as GPC).

In some examples, the hydrocarbyl substituent of the hydroxyaromatic compound used to prepare the Mannich Base detergent, which in some instances is or comprises polyisobutylene, may exhibit a number average molecular weight of from 700 to 1500, such as from 900 to 1300.

Examples of suitable Mannich Base detergents include those disclosed in, and/or obtained or obtainable by methods described in, U.S. Pat. Nos. 5,634,951, 5,697,988, 6,800,103, 7,597,726 and/or US20090071065.

Examples of suitable Mannich Base detergents include those disclosed in, and/or obtained or obtainable by methods described in, U.S. Pat. No. 5,634,951. Thus, examples of suitable Mannich Base detergents include those obtainable or obtained by the reaction of (i) one mole part of at least one hydroxyaromatic compound comprising on the ring an aliphatic hydrocarbyl substituent derived from a polyolefin exhibiting a number average molecular weight in the range of 500 to 3000, (ii) from 0.8 to 1.3 mole part(s) of at least one aldehyde, and (iii) from 0.8 to 1.5 mole part(s) of at least one aliphatic polyamine comprising in the molecule one primary or secondary amino group capable of undergoing a Mannich condensation reaction with (i) and (ii), the other amino group or groups (if any) in the molecule being substantially inert towards participation in such Mannich condensation reaction, with the proviso that the mole ratio of aldehyde to amine is 1.2 or less.

Examples of suitable hydroxyaromatic compounds (i) include high molecular weight alkyl-substituted hydroxyaromatic compounds including polypropylphenol (including those formed by alkylating phenol with polypropylene), polybutylphenols (including those formed by alkylating phenol with polybutenes and/or polyisobutylene), and polybutyl-co-polypropylphenols (including those formed by alkylating phenol with a copolymer of butylene and/or isobutylene and propylene). Other hydroxyaromatic compounds include for example, long chain alkylphenols for example those made by alkylating phenol with copolymers of butylene and/or isobutylene and/or propylene and one or more mono-olefinic comonomers copolymerisable therewith (including for example ethylene, 1-pentene, 1-hexene, 1-octene, 1-decene and the like), for example those in which the copolymer contains at least 50% by weight of butylene and/or isobutylene and/or propylene units. The comonomers may be aliphatic and can also contain non-aliphatic groups (for example styrene, o-methylstyrene, p-methylstyrene, divinyl benzene and the like). Suitable examples include polybutylphenols (for example, formed by alkylating phenol with polybutylene), which polybutylene includes for example, polymers made from pure or substantially pure 1-butene or isobutene and mixtures made from two, or all three of 1-butene, 2-butene and isobutene. High reactivity polybutylenes are also suitable examples for making suitable hydrocarbyl-substituted hydroxyaromatic compounds. Examples of hydrocarbyl-substituted hydroxyaromatic compounds include para-substituted hydroxyaromatic compounds. Examples of hydrocarbyl-substituted hydroxyaromatic compounds include those with one, two or more than two hydrocarbyl substituents.

Examples of suitable polyamine reactants (iii) include alkylene polyamines for example containing a single reactive primary or secondary amino group. Examples include those comprising other groups including for example hydroxyl, cyano, amido and etc. Examples of suitable polyamines include aliphatic diamines, for example, those containing one primary or secondary amino group and one tertiary amino group. Examples include N,N,N",N"-tetraalkyldialkylenetriamines; N,N,N',N"-tetraalkyltrialkylenetetramines; N,N,N',N",N'"-pentaalkyltrialkylenetetramines; N,N-dihydroxyalkyl-α,ω-alkylenediamines; N,N,N'-trihydroxyalkyl-α,ω-alkylenediamines; tris(dialkylaminoalkyl) aminoalkylmethanes etc. including those for example, in which the alkyl groups are the same or different, including those that typically contain no more than 12 carbon atoms, for example 1 to 4 carbon atoms each e.g. methyl and/or ethyl. Examples of polyamines containing one reactive primary or secondary amino group that can participate in the Mannich condensation reaction and at least one sterically hindered amino group that cannot participate directly in the Mannich reaction include for example, N-(tert-butyl)-1,3-propanediamine; N-neopentyl-1,3-propranediamine; N-(tert-butyl)-1-methyl-1,2-ethanediamine; N-(tert-butyl)-1-methyl-1,3-propanediamine and 3,5-di(tert-butyl)aminoethylpiperazine.

Examples of suitable Mannich Base detergents also include those disclosed in, and/or obtained or obtainable by methods described in U.S. Pat. No. 5,697,988. Thus, examples of suitable Mannich Base detergents include Mannich reaction products of (i) a high molecular weight alkyl-substituted phenol, (ii) amine and (iii) aldehyde wherein (i), (ii) and (iii) are reacted in a ratio in the range of from 1.0:0.1-10.0:0.1-10. In at least some examples the Mannich reaction products are obtained or obtainable by condensing an alkyl-substituted hydroxyaromatic compound whose alkyl-substituent has a number average molecular weight (Mn) in the range of from 600 to 14000 for example polyalkylphenol whose polyalkyl substituent is derived or derivable from 1-mono-olefin polymers exhibiting a number average molecular weight in the range of from 600 to 3000, for example in the range of from 750 to 1200; an amine containing at least one >NH group, for example an alkylene polyamine as represented by the formula: $H_2N$-(A-NH—)$_x$H in which A is a divalent alkylene group containing 1 to 10 carbon atoms and x is an integer in the range of from 1 to 10; and an aldehyde, for example formaldehyde in the presence of a solvent. Suitable reaction conditions include one or more of the following:

- operating at a temperature in the range of from room temperature to 95° C.;
- reacting the compounds alone or in the presence of an easily removable solvent for example benzene, xylene, toluene, or solvent refined neutral oil;
- using formaldehyde (e.g. formalin) as the aldehyde;
- heating the reaction mixture at an elevated temperature (for example 120° C. to 175° C.) whilst for example, blowing inert stripping gas (e.g. nitrogen, carbon dioxide and the like) until dehydration is complete; and filtering the reaction product and diluting with solvent.

Examples of Mannich reaction products include those derived or derivable by reacting an alkylphenol, an ethylene polyamine and a formaldehyde in respective molar ratio of 1.0:0.5-2.0:1.0-3.0 wherein the alky group of the alkyl phenol exhibits a number average molecular weight (Mn) in the range of from 600 to 3000, for example in the range of from 740 to 1200 or in the range of from 800 to 950 or for example 900. Examples of alkyl-substituted hydroxyaromatic compounds include para-substituted mono-alkylphenols and ortho mono-alkylphenols and dialkyl phenols. Examples of amine reactants include polyamines, for example polyethylene amines. Examples of amine reactants also include mono and di-amino alkanes and their substituted analogs, for example ethylamine, dimethylamine, dimethylaminopropyl amine and diethanol amine; aromatic diamines, (e.g. phenylene diamine and diamine naphthalenes); heterocyclic amines (e.g. morpholine, pyrrole, pyrrolidine, imidazole, imidazolidine and piperidine); melamine; and their substituted analogs. Examples of amine reactants include alkylene polyamines, for example polyamines that are linear, branched or cyclic; mixtures of linear and/or branched and/or cyclic polyamines wherein each alkylene group contains from 1 to 10 carbon atoms, for example from 2 to 20 carbon atoms. Examples of polyamines include those containing from 3 to 7 nitrogen atoms.

Examples of suitable Mannich Base detergents also include those disclosed in, and/or obtained or obtainable by methods described in, U.S. Pat. No. 6,800,103. Thus, examples of suitable Mannich Base detergents include those obtained or obtainable by reacting a mixture of (i) at least one substituted hydroxyaromatic compound containing on the ring both (a) an aliphatic hydrocarbyl substituent derived from a polyolefin exhibiting a number average molecular weight in the range of 500 to 3000 and (b) a $C_{1-4}$ alkyl; (ii) at least one secondary amine; and (iii) at least one aldehyde. In at least some examples components (ii) and (iii) are pre-reacted to from an intermediate prior to addition of component (i). In at least some examples a mixture formed from components (i), (ii) and (iii) is heated at a temperature above 40° C. at which Mannich condensation reaction takes place.

In at least some examples the Mannich reaction products is obtained or obtainable by reacting a di-substituted hydroxyaromatic compound in which the hydrocarbyl substituent (a) comprises polypropylene, polybutylene or an ethylene alpha-olefin copolymer exhibiting a number average molecular weight in the range of 500 to 3000 and a polydispersity in the range of 1 to 4, one or more secondary amines and at least one aldehyde. In at least some examples there is used dibutyl amine as the amine, formaldehyde or formalin as the aldehyde and a molar ratio of the substituted hydroxyaromatic compound to dibutyl amine to formaldehyde of 1:0.8-1.5:0.8-1.5 respectively, for example 1:0.9-1.2:0.9-1.2, respectively.

Examples of representative di-substituted hydroxyaromatic compounds include those represented by the general formula (VII):

(VII)

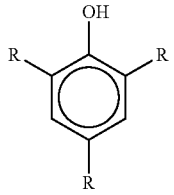

in which each R is H, $C_{1-4}$ alkyl or a hydrocarbyl substituent exhibiting a number average molecular weight in the range of 500 to 3000, with the proviso that one R is H, one R is a $C_{1-4}$ alkyl and one R is a hydrocarbyl substituent.

Examples of representative hydrocarbyl substituents of the hydrocarbyl-substituted hydroxyaromatic compound (ii) include polyolefin polymers for example polypropylene, polybutenes, polyisobutylene, ethylene alpha-olefin copolymers and the like. Other examples include copolymers of butylene and/or isobutylene and/or propylene and one or more mono-olefinic comonomers copolymerisable therewith (for example ethylene, 1-pentene, 1-hexene, 1-octene, 1-decene and the like) where the comonomer molecule contains at least 50% by weight of butylene and/or isobutylene and/or propylene units. In some examples the copolymers are aliphatic and in some examples contain non-aliphatic groups (for example styrene, o-methylstyrene, p-methylstyrene, divinyl benzene and the like), in any case the resulting polymers are substantially aliphatic hydrocarbon polymers. High reactivity polybutylenes are also suitable for making suitable hydrocarbyl-substituted hydroxyaromatic compounds.

Examples of suitable di-substituted hydroxyaromatic compounds include those obtained or obtainable by alkylating o-cresol with the high molecular weight polymers described above.

Suitably in at least some examples, the hydrocarbyl substituent is in the para-position of the disubstituted hydroxyaromatic compound and the $C_{1-4}$ alkyl substituent is in the ortho-position.

Examples of representative secondary amines (ii) include those represented by the general formula (VIII):

(VIII)

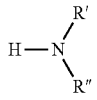

in which R' and R" are each independently alkyl, cycloalkyl, aryl, alkaryl or aralkyl groups containing from 1 to 30 carbon atoms, for example 1 to 18 carbon atoms or 1 to 6 carbon atoms. Examples include dimethylamine, diethylamine, dipropylamine, dibutylamine, dipentylamine and dicyclohexylamine.

Examples of suitable Mannich Base detergents also include those disclosed in, and/or obtained or obtainable by methods described in U.S. Pat. No. 7,597,726. Thus, examples of suitable Mannich Base detergents include Mannich condensation reaction products of (i) a polyamine containing a sterically-hindered primary amino group, (ii) a hydrocarbyl-substituted hydroxyaromatic compound and (iii) and aldehyde. Examples of polyamines (i) containing a sterically-hindered primary amino group include (A) aliphatic cyclic polyamines containing a sterically-hindered primary amino group, (B) acyclic aliphatic polyamines containing a sterically-hindered primary amino group and combinations thereof. In at least some examples the Mannich reaction product is obtained or obtainable by reacting (1) 1,2-diaminocyclohexane, (2) polyisobutylene-substituted cresol and/or phenol, and (3) formaldehyde, for example in which the reactants (1), (2) and (3) are reacted in equimolar proportions in a Mannich reaction. In at least some examples the Mannich reaction product is dispersed in a liquid carrier fluid. In at least some examples the polyamine reactant contains an amino group that does not participate in the Mannich condensation reaction with the hydrocarbyl-substituted hydroxyaromatic reactant in addition to at least one reactive amino group in the same polyamine molecule that takes part in the Mannich reaction. Examples of reactive amino groups include primary and secondary amino groups, for example non-sterically hindered reactive primary amino groups. Examples of polyamines containing a reactive amino group and a sterically-hindered amino group include those represented by the formula (IX):

(IX)

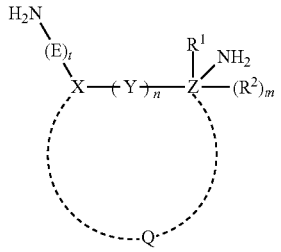

wherein X and Z each is methylene, Y is an alkylene or alkyleneamino group, n is 0 or 1, Q is an optional alkylene group suitable for forming a ring structure with X and Z, E is a hydrocarbyl group, t is 0 or 1, $R^1$ is a hydrocarbyl group or hydrogen provided that $R^1$ is hydrocarbyl if n is 1, $R^2$ is hydrogen or a hydrocarbyl group, m is 0 or 1 provided that m is 0 if Q is present. If $R^1$ and/or $R^2$ is hydrocarbyl, examples of such hydrocarbyl groups include $C_1$ to $C_8$ alkyl (for example methyl, ethyl, propyl, isopropyl, t-butyl and the like). Where n is 1, examples of Y include $C_1$ to $C_8$ alkylene; alkyleneamino (for example methyleneamino, (—$CH_2$N(H)—), dimethyleneamino (—$CH_2$N(H)—$CH_2$—), methyleneamino-ethylmethyleneamino (—$CH_2$N(H)—$C_2H_4$N(H)—$CH_2$—) and the like). Where t is 1, examples of E include methylene, ethylene, isopropylene and the like. Examples of Q include alkylene chains, for example $C_2$-$C_4$ alkylene chains. Examples of polyamines containing a sterically hindered primary amino group include aliphatic cyclic polyamines, including for example, polyaminocycloalkanes, for example polyaminocyclohexanes, including 1,2-diaminodicyclohexanes, 1,3-diaminodicyclohexanes and 1,4-diaminodicyclohexanes, for example as represented by the following formulae Xa, Xb and Xc:

Xa

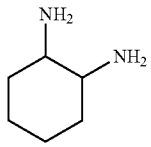

-continued

Xb

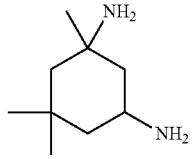

Xc

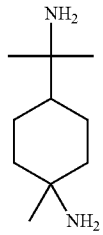

In at least some examples in the aliphatic cyclic polyamine structure, a sterically hindering hydrocarbyl group generally is bonded to the same carbon atom from which the sterically-hindered primary amino group is bonded when the hindered/protected and reactive amino groups are present in an arrangement other than an ortho configuration relative to each other. In at least some examples (for example compound Xc), a reactive amino group is present as a moiety of an intervening substituent that is directly attached to the ring structure. In at least some examples mixtures of isomers are used. Examples of suitable acyclic aliphatic polyamine reactants include alkylene polyamines containing a primary amino group that is physically sterically-protected to prevent or at least significantly hinder its ability to participate in the Mannich condensation reaction. In at least some examples the sterically hindered primary amino group is generally attached to either a secondary or tertiary carbon atom in the polyamine compound. The acyclic aliphatic polyamine has a suitably reactive amino group (for example primary or secondary) in the same molecule for participating in the Mannich condensation reaction. In at least some examples other substituents are present, for example hydroxyl, cyano, amido and the like. Examples of acyclic aliphatic polyamines containing a sterically hindered primary amino group include those represented by formulae XIa, XIb, XIc and XId:

XIa

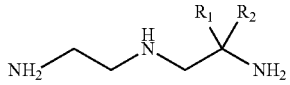

wherein each $R_1$ and $R_2$ are a hydrocarbyl group or a hydrogen provided that at least one thereof is a hydrocarbyl group. Examples of hydrocarbyl groups include $C_1$ to $C_8$ alkyl e.g. methyl, ethyl, propryl, isopropyl and the like;

XIb

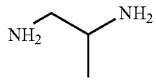

XIc

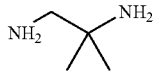

-continued

XId

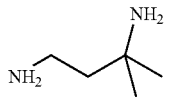

Examples of hydrocarbyl-substituted hydroxyaromatic compounds (ii) include those represented by formula XII:

XII

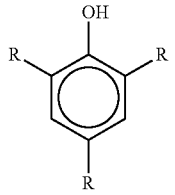

in which each R is H, $C_{1-4}$ alkyl or a hydrocarbyl substituent exhibiting an average molecular weight (Mw) in the range of 300 to 2000, for example 500 to 1500, for example as measured by gel permeation chromatography, with the proviso that at least one R is H and one R is a hydrocarbyl substituent as hereinbefore defined.

Examples of representative hydrocarbyl substituents of the hydrocarbyl-substituted hydroxyaromatic compound (ii) include polyolefin polymers for example polypropylene, polybutenes, polyisobutylene, ethylene alpha-olefin copolymers and the like. Other examples include copolymers of butylene and/or isobutylene and/or propylene and one or more mono-olefinic comonomers copolymerisable therewith (for example ethylene, 1-pentene, 1-hexene, 1-octene, 1-decene and the like) where the comonomer molecule contains at least 50% by weight of butylene and/or isobutylene and/or propylene units. In some examples the copolymers are aliphatic and in some examples contain non-aliphatic groups (for example styrene, o-methylstyrene, p-methylstyrene, divinyl benzene and the like), in any case the resulting polymers are substantially aliphatic hydrocarbon polymers.

In at least some examples hydrocarbyl substituents include polymers obtained or obtainable from pure or substantially pure 1-butene; polymers obtained or obtainable from pure or substantially pure isobutene; and polymer obtained or obtainable from mixtures of 1-butene, 2-butene and isobutene. In at least some examples the hydrocarbyl-substituted hydroxyaromatic reactant is obtained or obtainable from highly reactive polyisobutene.

In at least some examples a suitable di-substituted hydroxyaromatic compound is obtained or obtainable by alkylating o-cresol with a high molecular weight hydrocarbyl polymer, for example a hydrocarbyl polymer exhibiting an average molecular weight in the range of from 300 to 2000, for example by alkylating o-cresol or o-phenol with polyisobutylene exhibiting an average molecular weight in the range of from 300 to 2000, for example in the range of from 500 to 1500.

Examples of suitable Mannich Base detergents also include those disclosed in, and/or obtained or obtainable by methods described in US20090071065. Thus, examples of suitable Mannich Base detergents include Mannich condensation reaction products of: (i) a polyamine having primary amino groups, (ii) a hydrocarbyl-substituted hydroxyaromatic compound, and (iii) an aldehyde, where the Mannich reaction is conducted at an overall molar ratio of (i):(ii):(iii) such that, for example, the polyamine (i) is reactable with the hydrocarbyl-substituted hydroxyaromatic compound (ii) so as to obtain the substantially pure intermediate, which intermediate is reactable with the aldehyde (iii) to obtain the Mannich reaction product, for example in a one-pot reaction process. Examples of polyamine (i) include 1,2-diaminocyclohexane, 1,3-diamino propane and 1,2-diamino ethane. Examples of suitable molar ratios (i):(ii):(iii) include 1:2:3 and 1:1:2. Examples of hydrocarbyl-substituted hydroxyaromatic compounds include those represented by formula (XIII):

(XIII)

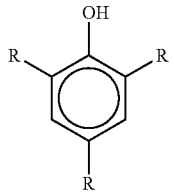

in which each R is H, $C_{1-4}$ alkyl, or a hydrocarbyl substituent exhibiting an average molecular weight (Mw) in the range of 300 to 2000, for example 500 to 1500, for example as determined by gel permeation chromatography, with the proviso that at least R is H and one R is a hydrocarbyl substituent as hereinbefore defined. Examples of hydrocarbyl substituents include polyolefin polymers, for example polypropylene, polybutylene, polyisobutylene and ethylene alpha-olefin copolymers and also copolymers of butylene and/or isobutylene and/or propylene and one or more mono-olefinic comonomers copolymerisable therewith (for example ethylene, 1-pentene, 1-hexene, 1-octene, 1-decene and the like) wherein the copolymer contains at least 50% by weight of butylene and/or isobutylene and/or propylene units. In at least some examples polyolefin polymer hydrocarbyl substituents contain at least 20%, for example 50%, or 70% of their olefin double bonds at a terminal position on the carbon chain as the highly reactive vinylidene isomer. Examples of hydrocarbyl substituents include those obtained or obtainable from polyisobutylene, for example polyisobutylene obtained or obtainable from pure or substantially pure 1-butene or isobutene and polymers obtained or obtainable from mixtures of two or three of 1-butene, 2-butene and isobutene. Examples of hydrocarbyl substituents include those obtained or obtainable from high reactivity polyisobutylene which have a relatively high proportion of polymer having terminal vinylidene groups, for example at least 20%, 50% or 70% of the total terminal olefinic double bonds in the polyisobutylene comprise an alkyl vinylidene isomer.

In at least some examples the at least one hydrocarbyl-substituted aromatic compound, such as the at least one Mannich Base detergent, is present in the fuel composition at a concentration of actives in the range of from 10 ppm to 500 ppm, for example in the range of from 20 to 200 ppm, such as from 20 to 100 ppm. Concentration of actives means the concentration of the active hydrocarbyl-substituted aromatic compound disregarding for example, any solvent and the like.

Typically, the at least one hydrocarbyl-substituted aromatic compound, such as the at least one Mannich Base detergent, will be present/used in the fuel composition at a concentration of actives of from 20 ppm to 70 ppm. In some examples, however, higher treat rates may be used. In such instances, the at least one hydrocarbyl-substituted aromatic compound may be present/used in the fuel composition at a concentration of from 70 ppm to 200 ppm.

In some examples, the at least one polyalkylene amine is present/used in the fuel composition at a concentration of actives of from 50 ppm to 500 ppm and the at least one hydrocarbyl-substituted aromatic compound is present/used in the fuel composition at a concentration of actives of from 20 ppm to 200 ppm. Typically, the at least one polyalkylene amine may be present/used in the fuel composition at a concentration of actives of from 50 ppm to 160 ppm and the at least one hydrocarbyl-substituted aromatic compound may be present/used in the fuel composition at a concentration of actives of from 20 ppm to 70 ppm. However, in some examples, the at least one polyalkylene amine may be present/used in the fuel composition at a concentration of actives of from 160 ppm to 500 ppm and the hydrocarbyl-substituted aromatic compound may be present/used in the fuel composition at a concentration of actives of from 70 ppm to 200 ppm.

In at least some examples the weight ratio of actives of the at least one polyalkylene amine:the at least one hydrocarbyl-substituted aromatic compound is in the range of 10:1 to 1:10 for example 5:1 to 1:5. Where a polyisobutylene amine and Mannich Base detergent are used, the weight ratio of actives of polyisobutylene amine:Mannich Base detergent is in the range of 10:1 to 1:10 for example 5:1 to 1:5.

Typically, the at least one polyalkylene amine (such as polyisobutylene amine), contains a polyalkylene group that exhibits a number average molecular weight of from 700 to 1500 (e.g. from 800 to 1200) and the hydrocarbyl substituent of the at least one hydrocarbyl-substituted aromatic compound (such as a Mannich Base detergent), which in some instances is or comprises polyisobutylene, exhibits a number average molecular weight of from 700 to 1500 (e.g. 900 to 1300).

Carrier Fluid

In at least some examples, at least one carrier fluid (sometimes also called induction aid or fluidiser) is present/used in the fuel composition, the uses and/or the methods. In at least some examples more than one carrier fluid is present/used.

In at least some examples the at least one carrier fluid is provided with the polyisobutylene amine. In at least some examples the at least one carrier fluid is provided with the Mannich Base detergent. In at least some examples at least one carrier fluid is provided with each of the at least one polyisobutylene amine and the at least one Mannich Base detergent, which carrier fluids may be the same or different. In at least some examples the carrier fluid is provided independently of the at least one polyisobutylene amine and the at least one Mannich Base detergent.

Examples of suitable carrier fluids are described for example in US2009/0071065 at paragraphs [0038] to [0053]. Thus, examples of suitable carrier fluid include liquid poly-alpha olefin oligomers, liquid polyalkene hydrocarbons (for example polypropylene, polybutenes, polyisobutene and the like), liquid hydrotreated polyalkene hydrocarbons (for example hydrotreated polypropylene, hydrotreated polybutenes, hydrotreated polyisobutene and the like), mineral oils, liquid poly(oxyalkylene) compounds, liquid alcohols, liquid polyols, liquid esters and the like.

Examples of carrier fluids include (1) a mineral oil or blend of mineral oils, for example those exhibiting a viscosity index of less than 120; (2) one or a blend of poly alpha olefins, for example those exhibiting an average molecular weight in the range of from 500 to 1500; (3) polyethers including poly(oxyalkylene) compounds, for example those exhibiting an average molecular weight in the range of from 500 to 1500; (4) one or more liquid polyalkylenes; and (5) mixtures of two or more selected from the group consisting of (1), (2), (3) and (4).

Examples of suitable mineral oil carrier fluids include paraffinic, naphthenic and asphaltic oils, for example hydrotreated oils. Examples of mineral oils exhibit a viscosity at 40° C. of less than 1600 SUS, for example 300 to 1500 SUS and/or exhibit a viscosity index of less than 100, for example in the range 30 to 60.

Examples of suitable poly alpha olefin carrier fluids include hydrotreated and unhydrotreated poly alpha olefins. Examples of poly alpha olefins include trimmers, tetramers and pentamers of alpha olefin monomers containing 6 to 12 carbon atoms.

Examples of suitable polyether carrier fluids include poly(oxyalkylene) compounds exhibiting an average molecular weight in the range of from 500 to 1500, including for example hydrocarbyl-terminated poly(oxyalkylene) monols. Examples of poly(oxyalkylene) compounds include one or a mixture of alkylpoly(oxyalkylene)monols which in its undiluted state is a gasoline-soluble liquid exhibiting a viscosity of at least 70 cSt at 40° C. and at least 13 cSt at 100° C., including such monols formed by propoxylation of one or a mixture of alkanols containing at least 8 carbon atoms, for example 10 to 18 carbon atoms.

Examples of suitable poly(oxyalkylene) carrier fluids include those exhibiting a viscosity in the undiluted state of at least 60 cSt at 40° C. (for example at least 70 cSt at 40° C.) and at least 11 cSt at 100° C. (for example at least at least 13 cSt at 100° C.). Examples of suitable poly(oxyalkylene) carrier fluids include those exhibiting a viscosity in the undiluted state of no more than 400 cSt at 40° C. (for example no more than 300 cSt at 40° C.) and no more than 50 cSt at 100° C. (for example no more than 40 cSt at 100° C.).

Examples of poly(oxyalkylene) compounds include poly(oxyalkylene)glycol compounds and monoether derivatives thereof, for example those that satisfy the above viscosity requirements, including those that are obtained or obtainable by reacting an alcohol or polyalcohol with an alkylene oxide, for example propylene oxide and/or butylene oxide with or without the use of ethylene oxide, for example products in which at least 80 mol. % of the oxyalkylene groups in the molecule are derived or derivable from 1,2-propylene groups.

Examples of poly(oxyalkylene) compounds include those disclosed in, and/or obtained or obtainable by methods described in, U.S. Pat. Nos. 248,664, 2,425,845, 2,425,755 and 2,457,139.

The poly(oxyalkylene) carrier compounds should contain sufficient branched oxyalkylene units (for example methyldimethyleneoxy units and/or ethyldimethyleneoxy units) to render the poly(oxyalkylene) compound gasoline soluble.

Examples of polyalkylene carrier fluids include polypropenes, polybutenes, polyisobutenes, polyamylenes, copolymers of propene and butene, copolymers of butene and isobutene, copolymers of propene and isobutene and copolymers of propene, butene and isobutene and mixtures thereof.

Examples of polyalkylene carrier fluids also include hydrotreated polypropylenes, hydrotreated polybutenes, hydrotreated polyisobutenes and the like.

Examples of polybutenes carrier fluids include those exhibiting a narrow molecular weight distribution, for example as expressed as the ratio Mw/Mn that is, (mass average molecular mass)/(the number average molecular mass), this ratio is sometimes called the polydispersity index. Examples of polybutenes carrier fluids include those exhibiting a narrow molecular weight distribution, expressed as the ratio Mw (mass average molecular mass)/Mn the number average molecular mass of 1.4 or less, for example as described in U.S. Pat. No. 6,048,373. Methods of determining mass average molecular mass include static light scattering, small angle neutron scattering, X-ray scattering, and sedimentation velocity. Number average molecular mass or weight (Mn) can be determined by gel permeation chromatography.

The fuel composition is suitable for use for example, in a spark ignition internal combustion engine.

In at least some examples the fuel composition has a sulphur content of up to 50.0 ppm by weight, for example up to 10.0 ppm by weight.

Examples of suitable fuel compositions include leaded and unleaded fuel compositions.

In at least some examples the fuel composition meets the requirements of EN 228, for example as set out in BS EN 228:2008. In at least some examples the fuel composition meets the requirements of ASTM D 4814-09b.

In at least some examples the fuel composition for spark-ignition internal combustion engines exhibits one or more (for example all) of the following, for example, as defined according to BS EN 228:2008: —a minimum research octane number of 95.0, a minimum motor octane number of 85.0 a maximum lead content of 5.0 mg/l, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

Examples of suitable fuel compositions include for example hydrocarbon fuels, oxygenate fuels and combinations thereof.

Hydrocarbon fuels may be derived from mineral sources and/or from renewable sources such as biomass (e.g. biomass-to-liquid sources) and/or from gas-to-liquid sources and/or from coal-to-liquid sources.

Examples of suitable oxygenate fuel components in the fuel composition include straight and/or branched chain alkyl alcohols having from 1 to 6 carbon atoms, for example methanol, ethanol, n-propanol, n-butanol, isobutanol, tert-butanol. Suitable oxygenate components in the fuel composition for spark-ignition internal combustion engines include ethers, for example having 5 or more carbon atoms, for example methyl tert-butyl ether and ethyl tert-butyl ether. In at least some examples the fuel composition has a maximum oxygen content of 2.7% by mass. In at least some examples fuel composition has maximum amounts of oxygenates as specified in EN 228, for example methanol: 3.0% by volume, ethanol: 5.0% by volume, iso-propanol: 10.0% by volume, iso-butyl alcohol: 10.0% by volume, tert-butanol: 7.0% by volume, ethers (for example having 5 or more carbon atoms): 10% by volume and other oxygenates (subject to suitable final boiling point): 10.0% by volume. In at least some examples fuel composition comprises ethanol complying with EN 15376 at a concentration of up to 15% by volume, for example up to 10% by volume or up to 5.0% by volume. Examples of oxygenate-containing fuel compositions include E5, E10, E15 and fuel compositions containing ethanol at higher concentrations, for example up to E85.

According to another aspect of the present invention there is provided a method of reducing the direct injection valve deposit forming tendency, preferably the air intake valve deposit forming tendency, of a fuel composition for use in a direct injection spark-ignition internal combustion engine which method comprises incorporating into the fuel composition in one or more steps:

a. at least one hydrocarbyl-substituted aromatic compound; and b. at least one polyalkylene amine to produce a fuel composition which comprises said additives in combination and which on combustion in a direct injection spark-ignition engine produces less valve deposits than the valve deposits formed when combusting in said engine the fuel composition without said combination of additives.

In at least some examples, the hydrocarbyl-substituted aromatic compound and the at least one polyalkylene amine are incorporated into the fuel composition separately or together as components of one or more additive concentrates, one or more additive packages and/or one or more additive part packs.

In at least some examples the fuel composition and/or additive concentrates, and/or additive packages and/or additive part packs comprise at least one other fuel additive. In at least some examples the method of reducing the direct injection air intake deposit forming tendency of a fuel composition comprises incorporating in one or more steps at least one other fuel additive.

In at least some examples the additives are admixed and/or incorporated as one or more additive concentrates and/or additive part packs, optionally comprising solvent or diluent.

In at least some examples the fuel composition is prepared by admixing in one or more steps, one or more base fuels (for example hydrocarbon fuels, oxygenate fuels and combinations thereof) and components therefor, optionally with one or more additives and/or part additive package concentrates. In at least some examples the additives, additive concentrates and/or part additive package concentrates are admixed with the fuel or components therefor in one or more steps.

Examples of such other fuel additives include friction modifiers, antiwear additives, corrosion inhibitors, dehazers/demulsifiers, dyes, markers, odorants, octane improvers, combustion modifiers, antioxidants, antimicrobial agents, lubricity improvers and valve seat recession additives.

Representative suitable and more suitable independent amounts of additives (if present) in the fuel composition are given in Table 1. The concentrations expressed in Table 1 are by weight of active additive compounds that is, independent of any solvent or diluent.

In at least some examples, more than one of each type of additive is present. In at least some examples, within each type of additive, more than one class of that type of additive is present. In at least some examples more than one additive of each class of additive is present. In at least some examples additives are suitably supplied by manufacturers and/or suppliers in solvent or diluents.

TABLE 1

| ADDITIVE TYPE | Fuel Composition: Suitable amount (actives), (by weight) | Fuel Composition: More suitable amount (actives), if present (by weight) |
|---|---|---|
| at least one hydrocarbyl-substituted aromatic compound, such as a Mannich Base detergent | 10-500 ppm | 20-100 ppm |
| at least one polyalkylene amine, such as a polyisobutylene amine | 50-500 ppm | 50-300 ppm e.g. 100-300 ppm |
| Friction modifiers/anti wear additives | 10-200 ppm | |
| Corrosion inhibitors | 1-20 ppm | |
| Octane improvers and/or combustion improvers | 5-10000 ppm | |
| Anti-oxidants | 0.1-20 ppm | |
| Dehazers/demulsifiers | 0.1-20 ppm | |
| Dyes and/or markers | 0.1-20 ppm | |
| Odorants | 1-20 ppm | |
| Anti-microbial agents | 1-20 ppm | |
| Lubricity improvers | 10-200 ppm | |
| Valve seat recession additives | 1-15000 ppm | |

Examples of suitable friction modifiers and anti-wear additives include those that are ash-producing additives or ashless additives. Examples of friction modifiers and anti-wear additives include esters, for example glycerol monooleate, and fatty acids, for example oleic or stearic acid.

Examples of suitable corrosion inhibitors include ammonium salts of organic carboxylic acids, amines and heterocyclic aromatics, for example alkylamines, imidazolines and tolyltriazoles.

Examples of suitable non-metallic octane improvers include N-methyl aniline.

Examples of metal-containing octane improvers include methylcyclopentadienyl manganese tricarbonyl, ferrocene and tetra ethyl lead. Suitably, the fuel composition is free of all added metallic octane improvers including methyl cyclopentadienyl manganese tricarbonyl and other metallic octane improvers including for example, ferrocene and tetraethyl lead.

Examples of suitable anti-oxidants include phenolic anti-oxidants (for example 2,4-di-tert-butylphenol and 3,5-di-tert-butyl-4-hydroxyphenylpropionic acid) and aminic anti-oxidants (for example para-phenylenediamine, dicyclohexylamine and derivatives thereof).

Examples of suitable valve seat recession additives include inorganic salts of potassium or phosphorus.

In at least some examples the additive composition comprises solvent. Examples of suitable solvents include polyethers and aromatic and/or aliphatic hydrocarbons, for example heavy naphtha e.g. Solvesso (Trade mark), xylenes and kerosene.

In at least some examples the additives are present in the fuel composition at a total amount in the range of 20 to 25000 ppm by weight. Therefore, the concentrations of each additive in an additive concentrate will be correspondingly higher than in the fuel composition, for example by a ratio of 1:0.00002 to 0.025. In at least some examples the additives are used as part-packs, for example part of the additives (sometimes called refinery additives) being added at the refinery during manufacture of a fungible fuel and part of the additives (sometimes called terminal or marketing additives) being added at a terminal or distribution point.

In at least some examples the at least one hydrocarbyl-substituted aromatic compound and the at least one polyalkylene amine are incorporated or admixed with other components of the fuel composition as a refinery additive or as a marketing additive.

In at least some examples the at least one hydrocarbyl-substituted aromatic compound and the at least one polyalkylene amine are incorporated or admixed with other components of the fuel composition as a marketing additive, for example at a terminal or distribution point.

Examples of suitable direct injection spark-ignition internal combustion engines include boosted direct injection spark-ignition internal combustion engines, for example turbocharged boosted direct injection engines and supercharged boosted direct injection engines. Suitable engines include 2.0 L boosted direct injection spark-ignition internal combustion engines. Suitable direct injection engines include those that have side mounted direct injectors and/or centrally mounted direct injectors.

The fuel compositions are used to control deposit formation on valves in a direct injection engine. The valves may be air intake valves, exhaust valves or exhaust gas recirculation valves. It is particularly important that the fuel composition controls deposits on the air intake valves, as deposit build up here can lead to disruption of the air flow into the combustion chamber. This can lead to non-optimal air-fuel mixing across the cylinders in the engine which can have a detrimental impact on engine and vehicle parameters such as volumetric efficiency, power, acceleration, fuel economy, drivability and emissions.

Methods for assessing the enhanced valve deposit performance when the fuel composition is used to operate a direct injection spark-ignition internal combustion engine include assessing the deposits on the valves by weighing and/or by assigning numerical ratings by visual inspection by trained technicians. For example the enhanced direct injection intake valve deposit performance of a fuel may be assessed according to ASTM D-6201 (e.g. version 04, 2009).

In at least some examples determination of intake valve deposits takes place after operating the spark-ignition internal combustion engine under conditions to induce blow-by flow into the engine inlet system just upstream of the air intake valves, for example by operating a four-stage test cycle of steady-state stages running at engine speeds of between 1000 and 2000 rpm and with engine loads of between 1 and 5 bar Brake Mean Effective Pressure for a total duration of greater than 100 hours.

It is also desirable that the fuel composition used in the present invention exhibit adequate detergency elsewhere in the spark-ignition internal combustion engine, such as on the direct injectors. Methods for assessing the detergency effect of the fuel composition on the direct injectors of a spark-ignition internal combustion engine include assessing the deposits that form on the direct injectors by carrying out static injector flow tests.

Further aspects of the present invention include the aspects, embodiments, instances and examples defined above but in which a Mannich Base detergent is used as component a. In these aspects, the Mannich Base detergent may be, but does not have to be, a hydrocarbyl-substituted aromatic compound.

According to these further aspects, there is provided a method of controlling deposit formation on air intake valves in a direct injection spark-ignition internal combustion engine which method comprises supplying to the engine, a fuel composition which comprises:

a. at least one Mannich Base detergent; and b. at least one polyisobutylene amine.

According to these further aspects, there is also provided the use as an air intake valve deposit controlling additive in a fuel composition for a direct injection spark-ignition internal combustion engine of a combination of:

a. at least one Mannich Base detergent; and b. at least one polyisobutylene amine.

According to these further aspects, there is also provided a method of reducing the direct injection air intake valve deposit forming tendency of a fuel composition for use in a direct injection spark-ignition internal combustion engine which method comprises incorporating into the fuel composition in one or more steps:

a. at least one Mannich Base detergent; and b. at least one polyisobutylene amine to produce a fuel composition which comprises said additives in combination and which on combustion in a direct injection spark-ignition engine produces less air intake valve deposits than the air intake valve deposits formed when combusting in said engine the fuel composition without said combination of additives.

According to these further aspects, there is also provided a method of operating a direct injection spark-ignition internal combustion engine which method comprises supplying to the engine, a fuel composition which comprises a combination of:

a. at least one Mannich Base detergent; and b. at least one polyisobutylene amine.

In these further aspects, the polyisobutylene amine may be present/used in the fuel composition at a concentration of actives of at least 50 ppm, for example at a concentration of actives of at least 100 ppm. In at least some examples the polyisobutylene amine is present/used in the fuel composition at a concentration as actives of up to 500 ppm, for example at a concentration of up to 300 ppm. In at least some examples the polyisobutylene amine is present/used in the fuel composition at a concentration of actives in the range of from 50 ppm to 500 ppm, for example at a concentration of actives in the range of from 100 ppm to 300 ppm.

In these further aspects, the Mannich Base detergent may be present in the fuel composition at a concentration of actives in the range of from 10 ppm to 500 ppm, for example in the range of from 20 to 100 ppm. Concentration of actives means the concentration of the active Mannich Base detergent disregarding for example, any solvent and the like.

In these further aspects, the weight ratio of actives of polyisobutylene amine:Mannich Base detergent may be in the range of 10:1 to 1:10 for example 5:1 to 1:5.

In these further aspects, the polyisobutylene amine may contain a polyisobutenic group that exhibits a number average molecular weight of from 200 to 10000, for example from 500 to 5000 or from 800 to 1200 or from 850 to 1100, for example about 1000.

In these further aspects, the Mannich Base detergent is obtainable by the reaction of at least one hydrocarbyl-substituted hydroxyaromatic compound, at least one amine and at least one aldehyde. The hydrocarbyl substituent of the aromatic group may be or comprise polyisobutylene. Examples of Mannich reaction products include those derived or derivable by reacting an alkylphenol, an ethylene polyamine and a formaldehyde in respective molar ratio of 1.0:0.5-2.0:1.0-3.0 wherein the alky group of the alkyl phenol exhibits a number average molecular weight (Mn) in the range of from 600 to 3000, for example in the range of from 740 to 1200 or in the range of from 800 to 950 or for example 900.

The polyisobutylene amine and Mannich base detergents used in these further aspects may also be as described elsewhere herein.

The invention will now be described by way of example only with reference to the following experiments and examples in which examples according to the present invention are labelled numerically as Example 1, Example 2 etc. and Experiments not according to the present invention are labelled alphabetically as Experiment A, Experiment B etc.

Air intake valve deposit formation was studied using a gasoline base fuel meeting E0 R95 EN 228 specifications. Fuels were prepared with and without deposit controlling additives as shown in Table 2. The fuel compositions were used to operate a 2.0 litre turbocharged direct injection spark ignition internal combustion engine. The engine was operated to induce blow-by flow into the engine inlet system just upstream of the air intake valves by operating a four-stage test cycle of steady-state stages running at engine speeds of between 1000 and 2000 rpm and with engine loads of between 1 and 5 bar Brake Mean Effective Pressure for a total duration of greater than 100 hours.

The mass of air intake valve deposits were determined by weighing the valves at the start and end of each test and subtracting the weight at the start from the weight at the end. The results are shown in Table 2.

Experiments A and B

The test was operated with an un-additised fuel—Experiment A. Experiment A was repeated—Experiment B. These experiments are not according to the invention because the fuel composition was un-additised and hence it did not comprise a combination of at least one Mannich Base detergent and at least one polyisobutylene amine.

Experiments C and D—Polyisobutene Amine Only

Experiment A was repeated using a fuel composition comprising polyisobutene amine with solvent and carrier—Experiment C. The amount of polyisobutylene amine was selected to give a typical port fuel injection intake valve deposit performance when measured using an M111 spark ignition internal combustion engine operated according to the industry standard test CEC-F-20-A-98. Experiment C was repeated—Experiment D.

These experiments are not according to the invention because the fuel composition contained polyisobutylene amine without any Mannich Base detergent and hence it did not comprise a combination of at least one Mannich Base detergent and at least one polyisobutylene amine.

EXAMPLE 1

Combination of Mannich Base Detergent and Polyisobutylene Amine

Experiment A was repeated using a fuel composition containing a combination of a Mannich Base detergent (Mannich Base detergent I, with solvent) and a polyisobutylene amine (with solvent and carrier fluid). The amount of Mannich Base detergent/polyisobutylene amine combination incorporated into the fuel was selected to give a typical port fuel injection intake valve deposit performance when measured using an M111 spark ignition internal combustion engine operated according to the industry standard test CEC-F-20-A-98 and which was comparable to that of the fuel compositions used for Experiments C and D.

This is an example according to the invention because the fuel composition comprised a combination of at least one Mannich Base detergent and at least one polyisobutylene amine.

Experiment E

Experiment A was repeated with an un-additised fuel. This experiment is not according to the invention because the fuel composition was un-additised and hence it did not comprise a combination of at least one Mannich Base detergent and at least one polyisobutylene amine.

Experiment F

Experiment A was repeated using a fuel composition containing a combination of two Mannich Base detergents (Mannich Base detergent I as used in Example 1 and Mannich Base detergent II) —Experiment F. The amount of Mannich Base detergent gave less port fuel injection intake valve deposit performance when measured using an M111 spark ignition internal combustion engine operated according to the industry standard test CEC-F-20-A-98 than that of the fuel compositions used for Experiments C and D.

This experiment is not according to the invention because the fuel composition contained Mannich Base detergent without any polyisobutylene amine and hence it did not comprise a combination of at least one Mannich Base detergent and at least one polyisobutylene amine.

Experiments G and H—Mannich Base Detergent Only

Experiment A was repeated using a fuel composition containing Mannich Base detergent only (Mannich Base detergent II as used in Experiment F) —Experiment G. Experiment G was repeated using a different Mannich Base detergent (Mannich Base detergent III) —Experiment H. The amount of Mannich Base detergent in each experiment was selected to give a typical port fuel injection intake valve deposit performance when measured using an M111 spark ignition internal combustion engine operated according to the industry standard test CEC-F-20-A-98 and which was comparable to that of the fuel compositions used for Experiments C and D.

These experiments are not according to the invention because the fuel compositions contained Mannich Base detergent without any polyisobutylene amine and hence they did not comprise a combination of at least one Mannich Base detergent and at least one polyisobutylene amine.

The results in Table 2 show that the fuel compositions containing polyisobutylene amine and no Mannich Base detergent exhibited higher air intake valve deposit formation than the un-additised fuel composition when used in a direct injection spark-ignition internal combustion engine.

TABLE 2

| | Additive(s) | Air Intake Valve Deposits in DI spark-ignition engine, mass % relative to Experiment A |
|---|---|---|
| Experiment A | None | 100 |
| Experiment B | None | 96 |
| Experiment C | Polyisobutylene amine | 121 |
| Experiment D | Polyisobutylene amine | 122 |
| Example 1 | Mannich Base Detergent (I) and Polyisobutylene Amine | 105 |
| Experiment E | None | 101 |
| Experiment F | Two Mannich Detergents (I and II) | 131 |
| Experiment G | Mannich Detergent (II) | 116 |
| Experiment H | Mannich Detergent (III) | 107 |

The results in Table 2 also show that the fuel compositions containing Mannich Base detergent and no polyisobutylene amine exhibited higher air intake valve deposit formation than the un-additised fuel composition when used in a direct injection spark-ignition internal combustion engine.

The results in Table 2 also show that incorporating into a fuel, a combination of Mannich Base detergent and polyisobutylene amine reduces the direct injection air intake valve deposit forming tendency of the fuel composition when used in a direct injection spark-ignition internal combustion engine. Thus, the amount of air intake valve deposits produced by a fuel composition containing a combination of Mannich Base detergent and polyisobutylene amine was less (when used in a direct injection spark-ignition internal combustion engine), or not greater than, the amount of deposits formed by fuel compositions containing one or other (but not both) of Mannich Base detergent and polyisobutylene amine. The comparison is made for example at concentrations of additives providing comparable port fuel injection intake valve deposit performance for example, when measured using an M111 spark ignition internal combustion engine operated according to the industry standard test CEC-F-20-A-98.

The different fuel compositions were run on a 2.0 litre direct injection spark ignition internal combustion engine. Injector flow loss from each test was measured using static injector flow tests to confirm that the detergency effects of the different fuel compositions on the direct injectors were comparable.

These data illustrate a method of controlling deposit formation on air intake valves in a direct injection spark-ignition internal combustion engine which method comprises supplying to the engine, a fuel composition which comprises: a. at least one Mannich Base detergent; and b. at least one polyisobutylene amine.

These data also illustrate the use as an air intake valve deposit controlling additive in a fuel composition for a direct injection spark-ignition internal combustion engine of a combination of: a. at least one Mannich Base detergent; and b. at least one polyisobutylene amine.

The results illustrate a method of reducing the direct injection air intake valve deposit forming tendency of a fuel composition for use in a direct injection spark-ignition internal combustion engine which method comprises incorporating into the fuel composition in one or more steps: a. at least one Mannich Base detergent; and b. at least one polyisobutylene amine to produce a fuel composition which comprises said additives in combination and which on combustion in a direct injection spark-ignition engine produces less air intake valve deposits than the air intake valve deposits formed when combusting in said engine the fuel composition without said combination of additives.

A method of operating a direct injection spark-ignition internal combustion engine which method comprises supplying to the engine, a fuel composition which a comprises combination of: a. at least one Mannich Base detergent; and b. at least one polyisobutylene amine is also illustrated by these results.

The data also illustrate that improved deposit control is exhibited by fuel compositions comprising at least one Mannich Base detergent and at least one polyisobutylene amine, as compared to a fuel composition exhibiting comparable detergency but comprising only one of at least one Mannich Base detergent and at least one polyisobutylene amine. Accordingly, in some examples, a combination of:

a. at least one Mannich Base detergent; and b. at least one polyisobutylene amine is used for improving the air intake valve deposit formation control performance of a fuel composition in a direct injection spark-ignition internal combustion engine.

What is claimed is:

1. A method of controlling deposit formation on a valve selected from air intake valves, exhaust valves, and exhaust gas recirculation valves in a direct injection spark-ignition internal combustion engine the method comprising:

providing the direct injection spark-ignition internal combustion engine comprising the valve selected from air intake valves, exhaust valves, and exhaust gas recirculation valves, and one or more fuel injectors;

supplying to the engine through the one or more fuel injectors a fuel composition which comprises:

a. at least one polyisobutylene-Mannich Base detergent, wherein the polyisobutylene substituent of the polyisobutylene-Mannich Base detergent exhibits a number average molecular weight of from 700 to 1500, the at least one polyisobutylene-Mannich Base detergent being present in the fuel composition at a concentration of actives of from 70 ppm to 200 ppm; and b. at least one polyisobutylene amine, wherein the polyisobutylene amine contains a polyisobutylene group that exhibits a number average molecular weight of from 700 to 1500, the at least one polyisobutylene amine being present in the fuel composition at a concentration of actives of from 160 ppm to 500 ppm; and combusting the fuel composition in the engine, the polyisobutylene-Mannich Base detergent and the polyisobutylene amine being present in the fuel composition in an amount that produces substantially less deposit formation on the valve than would be produced when the same fuel composition with the polyisobutylene amine but without the polyisobutylene-Mannich Base detergent is combusted in the engine.

2. The method of claim 1, wherein the valve is an exhaust valve or an exhaust gas recirculation valve.

3. The method of claim 1, wherein the valve is an air intake valve.

4. A method of operating a direct injection spark-ignition internal combustion engine comprising a valve selected from air intake valves, exhaust valves, and exhaust gas recirculation valves, the method comprising providing the direct injection spark-ignition internal combustion engine;

supplying to the engine a fuel composition which comprises a combination of:

a. at least one polyisobutylene-Mannich Base detergent, wherein the polyisobutylene substituent of the polyisobutylene-Mannich Base detergent exhibits a number average molecular weight of from 700 to 1500, the at least one polyisobutylene-Mannich Base detergent being present in the fuel composition at a concentration of actives of from 70 ppm to 200 ppm; and b. at least one polyisobutylene amine, wherein the polyisobutylene amine contains a polyisobutylene group that exhibits a number average molecular weight of from 700 to 1500, the at least one polyisobutylene amine being present in the fuel composition at a concentration of actives of from 160 ppm to 500 ppm; and combusting the fuel composition in the engine, each of the polyisobutylene-Mannich Base detergent and the polyisobutylene amine being present in the fuel composition in an amount that produces substantially less deposit formation on the valve than would be produced when the same fuel composition with the polyisobutylene amine but without the polyisobutylene-Mannich Base detergent is combusted in the engine.

* * * * *